United States Patent [19]

Ecalle et al.

[11] Patent Number: 4,966,632

[45] Date of Patent: Oct. 30, 1990

[54] PROCESS FOR THE ANNEALING TREATMENT OF METAL STRIPS

[75] Inventors: Olivier Ecalle, Versailles; Valéry Vinckx, Biganos, both of France

[73] Assignee: L'Air Liquide, Societe Anonyme pour l'Etude et l'Exploitation des Procedes Georges Claude, Paris, France

[21] Appl. No.: 323,564

[22] Filed: Mar. 14, 1989

[30] Foreign Application Priority Data

Mar. 16, 1988 [FR] France ..... 88 03372
Mar. 16, 1988 [FR] France ..... 88 03273

[51] Int. Cl.[5] ..... C21D 1/76

[52] U.S. Cl. ..... 148/16; 148/134; 148/135

[58] Field of Search ..... 148/16, 135, 134

[56] References Cited

U.S. PATENT DOCUMENTS

| | | | |
|---|---|---|---|
| 3,467,366 | 9/1969 | Westeren | 432/64 |
| 3,655,172 | 4/1972 | Ingels | 148/16 |

FOREIGN PATENT DOCUMENTS

| | | | |
|---|---|---|---|
| 75438 | 3/1980 | European Pat. Off. . | |
| 175640 | 3/1986 | European Pat. Off. . | |
| 0311030 | 4/1989 | European Pat. Off. | 148/16 |
| 51-13334 | 2/1976 | Japan | 148/16 |
| 621800 | 7/1978 | U.S.S.R. | 148/16 |
| 2135032 | 8/1984 | United Kingdom . | |

OTHER PUBLICATIONS

*Steel in the U.S.S.R.*, vol. 14, No. 8, Aug. 1984 "Bright Annealing of Steel Strip in Hydrogen Atmosphere".

*Primary Examiner*—Deborah Yee
*Attorney, Agent, or Firm*—Curtis, Morris & Safford

[57] ABSTRACT

An annealing treatment in a continuous furnace in which a flow of dense inert gas is injected in a rising duct and a descending duct, these flows being regulated by the analysis of hydrogen detected by a pressure controller acting on valves to achieve a minimum escape of hydrogen.

11 Claims, 2 Drawing Sheets

PROCESS FOR THE ANNEALING TREATMENT OF METAL STRIPS

BACKGROUND OF THE INVENTION

The present invention relates to the annealing treatment of metal articles, in particular of stainless steel, in a furnace having an entrance end zone for the metal articles to be treated connected to a heating zone followed by a cooling zone and an exit end zone for the treated metal articles, a gas having a high hydrogen content is injected in the heating zone and a dense inert gas is injected in the vicinity of said end zones. A furnace achieving this type of treatment is for example disclosed in the European patent application No. 0075,438. Usually there is injected in the annealing zone cracked ammonia having a hydrogen content of 75%, which may give rise to problems of nitriding for certain grades of steel due to the presence of nitrogen in the hot zone. A dense inert gas is injected at the ends of the furnace, which permits providing a required high pressure (usually on the order of 90 mm of water) of the gas having a high hydrogen content inside the furnace and increasing the hydrogen content of the gas injected in the active zone corresponding to the heating followed by the cooling.

It has been proposed to employ nitrogen as the dense neutral gas, but it has been found that this was not without drawbacks. Indeed, any maladjustment due to any cause, for example a drop in the internal high gas pressure of the furnace, resulting from wear of the sealing means at the entrance and the exit of the furnace or an inadaptation of the sealing means to the dimensions of a freshly introduced metal article; results in an inopportune propagation of the nitrogen toward the hot active zone which then seriously disturbs the annealing phenomenon may such disturbance form harmful nitriding; for example, this may occur following a sudden increase in the nitrogen admitted for compensating an occasional depression. On the other hand, if, for the purpose of compensating for a drop in the internal high pressure, the flow of hydrogen is increased one is confronted with an increase in the cost of the treatment.

This is the reason why it has been proposed to employ argon as the inert gas, whose possible presence in the hot zone is not harmful, but argon is however far more expensive than nitrogen.

SUMMARY

An object of the present invention is to optimize at each instant the injected dense inert gas this is achieved according to the invention by regulating the injection of the dense inert gas in an end zone under the control of a set value of the hydrogen content in a zone located in the vicinity of the hot zone adjacent to the end zone where the inert gas is injected under the control of the hydrogen content, in a way which increases the injection of the dense inert gas if the hydrogen content tends to increase, and vice versa. The flow of inert gas in said end zone is in any case maintained at a minimum value.

Furthermore, and according to a preferred form of the invention, the injection of the dense inert gas is regulated in the vicinity of the two end zones of the furnace under the control of the maintenance of the gas pressure in the furnace at a set value.

In this way, by individually regulating the different flows of dense inert gas entering the entrance zone and the cooling zone, a minimum escape of hydrogen toward the upstream end or downstream end is always ensured.

It has indeed been found that it is possible to avoid any propagation of hydrogen in the hot zone, and therefore to avoid any nitriding, by stabilizing a fixed front of gas by regulation of the injection of dense inert gas, either directly in the entrance zone, or in the vicinity of the entrance zone, or in the vicinity of the exit zone downstream of the zone in which the treated articles have been cooled to a temperature of 800° C. after passage in the hot zone.

Preferably, the maintenance of the hydrogen content at a set value is achieved on the upstream side of the hot zone and the injection of inert gas under the control of the maintenance of the hydrogen content at a set value is achieved in the vicinity of the entrance zone of the furnace.

In a preferred manner of carrying out the invention, the regulation of the injection of dense inert gas in the vicinity of the two end zones of the furnace is achieved by a simultaneous variation in the same sense of the injection flows in the vicinity of said ends of the furnace.

The set value of the hydrogen content in the zone located in the vicinity of the hot zone is between 75% and 99.9%. In the case of a furnace of the horizontal type, the set value of the hydrogen content is between 75% an 99% and preferably on the order of 90%.

In the case of a furnace of the vertical type having rising and descending ducts and in which said descending duct incorporates the heating zone and the cooling zone, the set value of the hydrogen content is between 85% and 99.9% and preferably on the order of 95 to 98%. The hydrogen content is maintained at a set value in the vicinity of the top of the rising duct.

This double system of regulation permits obtaining excellent results as to the quality of the treatment and the reduction in the outlays of gaseous fluid. There may be employed as the dense inert gas not only argon, carbon dioxide and other gases, but also hydrogen whose harmful nitriding effects are no longer liable to occur.

The invention also relates to a plant for the annealing treatment of metal articles, of the type comprising a furnace having an entrance end zone for the metal articles to be treated, connected to a heating zone followed by a cooling zone, and an exit end zone for the treated metal articles, with means for injecting gas having a high hydrogen content in a heating zone and means for injecting dense inert gas in the vicinity of the end zones of the furnace. The plant further comprises a flow regulator device interposed in a inert gas supply conduit supplying one of said end zones, said regulator device being under the control of an analyzer of the hydrogen content measured in the vicinity of the heating zone. Advantageously, the hydrogen analyzer is connected in the vicinity of the heating zone, upstream of said heating zone. The supply conduit having the regulator device is furthermore associated with two direct supply conduits having a regulating valve each opening out in an end zone of the furnace. The two inert gas injecting conduits each open out in the vicinity of a furnace end and are connected to a general inert gas supply conduit through a flow regulator device under the control of the pressure in the furnace. Preferably, the conduit having a flow regulator device under the control of an analyzer of the hydrogen content is itself connected to the general inert gas supply conduit on the downstream side of the flow regulator device under the control of the pressure in the furnace.

The features and advantages of the invention will moreover be apparent from the following description which is given by way of example with reference to the accompanying diagrammatic drawings.

DESCRIPTION OF CERTAIN PREFERRED EMBODIMENTS

Figure 1:
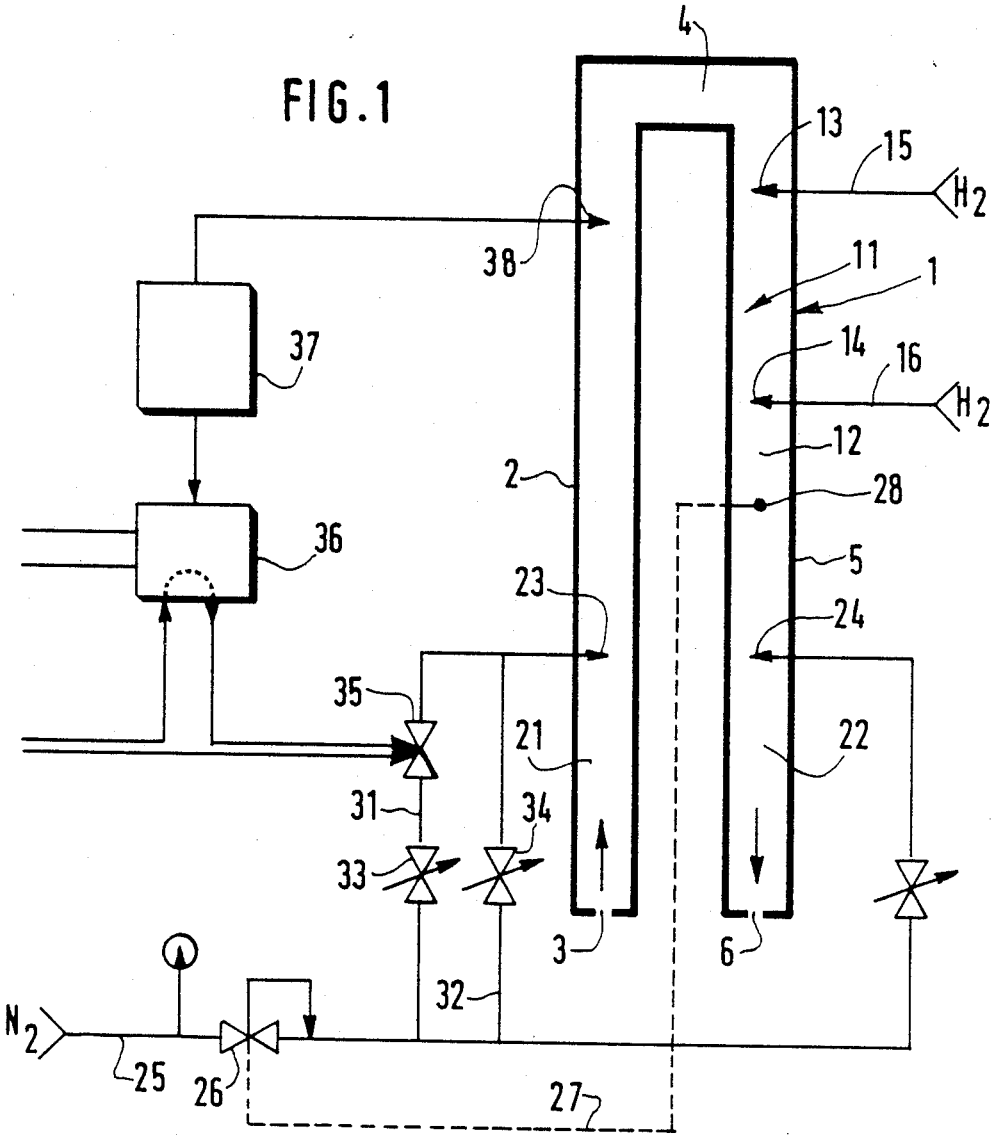
FIG. 1 is a schematic representation of a vertical furnace in accordance with one illustrative embodiment of the invention.

With reference to FIG. 1, a vertical furnace 1 comprises a rising duct 2 having an entrance opening 3 for a metal strip (not shown). The duct 2 is connected through a horizontal elbow 4 to a descending duct 5 having an exit opening 6 for said metal strip. The annealing is effected in an upper zone 11 of the descending duct 5 followed by a cooling zone 12. Provided at the level of the annealing zone 11 are injectors 13 and 14 which are connected to hydrogen supply conduits 15 and 16. Placed in a lower zone 21 of the rising duct 2 and in a lower zone 22 of the descending duct 5 are nitrogen injectors 23 and 24 connected to a nitrogen supply conduit 25 including a flow regulator 26 which is controlled via a line 27 by a pressure detector 28 in the descending duct 5.

The injector 23 in the rising duct 2 is supplied by the conduit 25 on the downstream side of the regulator 26 through two parallel conduits 31 and 32 each of which incorporates a regulating valve 33 and 34. The conduit 31 also incorporates an electrically operated valve 35 controlled through a threshold relay 36 by an analyzer 37 of hydrogen taken off at 38 in an upper zone of the rising duct 2.

The described plant operates in the following manner. The hydrogen flow is so regulated as to be fixed at a value which is as low as possible as a function the needs of the treatment. The injection of nitrogen in the low zones of the rising and descending ducts has essentially the effect of plugs enabling a slight internal high pressure to be achieved while avoiding as far as possible the escape of hydrogen through the entrance 3.

The function of the pressure regulator 26 is to react to possible pressure changes. Indeed, the injection of nitrogen within the cooling zone 12 will be amplified simultaneously at the two ends 3 and 6 of the furnace 1 as soon as a drop in the internal high pressure is detected by the pressure detector 28.

But if, with the internal pressure however correct, it is found that an excessive escape of hydrogen occurs in the rising duct in the direction of the entrance opening 3, the regulator device 35 immediately reacts to even a slight increase in the flow of hydrogen and additional nitrogen is conducted through the conduit 31 and thus directs the escaping hydrogen upward through the rising duct to a given rate. On the other hand, if the hydrogen content tends to drop below the minimum prescribed escape flow, and even tends to be cancelled out, which thus results in an excessive upward rise of nitrogen, the regulator device 35 brings about a reduction in the flow of nitrogen in the conduit 31 and thus avoids any rise of nitrogen which might reach the treatment zone 11. Note that it is sufficient to prevent the rise of nitrogen only in the rising duct since in effect the hydrogen has a natural tendency to escape via the descending duct, and a rise of nitrogen toward the treatment zone 11 through only the descending duct is highly unlikely.

In the embodiment shown in FIG. 1 the regulator 35 may also operate by "all or little", since a minimum flow of nitrogen is ensured via the conduit 32. This arrangement has the advantage of both simplicity and ruggedness, since the regulator 35 controls the infrequent openings and closures of the electrically operated valve associated therewith and of safety since, in the event of a breakdown of the regulation device, a minimum flow of nitrogen is always injected in the rising duct of the furnace through the conduit 32.

The "low" injection of nitrogen in the rising duct through the conduit 32 is preferably effected in the lower half of the height of the furnace so that the oxygen normally adsorbed on the metal strip can be desorbed and purged by the nitrogen before reaching the nitrogen injection zone beyond this injection zone, the metal strip is located in a zone which includes a low flow of escaping hydrogen. The two conduits 31 and 32 may have different outlets, the outlet of the conduit 32 being then located below that of the conduit 31.

A limiting factor from the point of view of the reduction of the flow related to this process may come from an insufficient elimination of soluble oils or soaps present on the strip when it enters the furnace. This would create an excessively high dew point which might oxidize the strip. To avoid this problem, it may be arranged to dry the strip before its introduction into the furnace, for example by heating.

Figure 2:
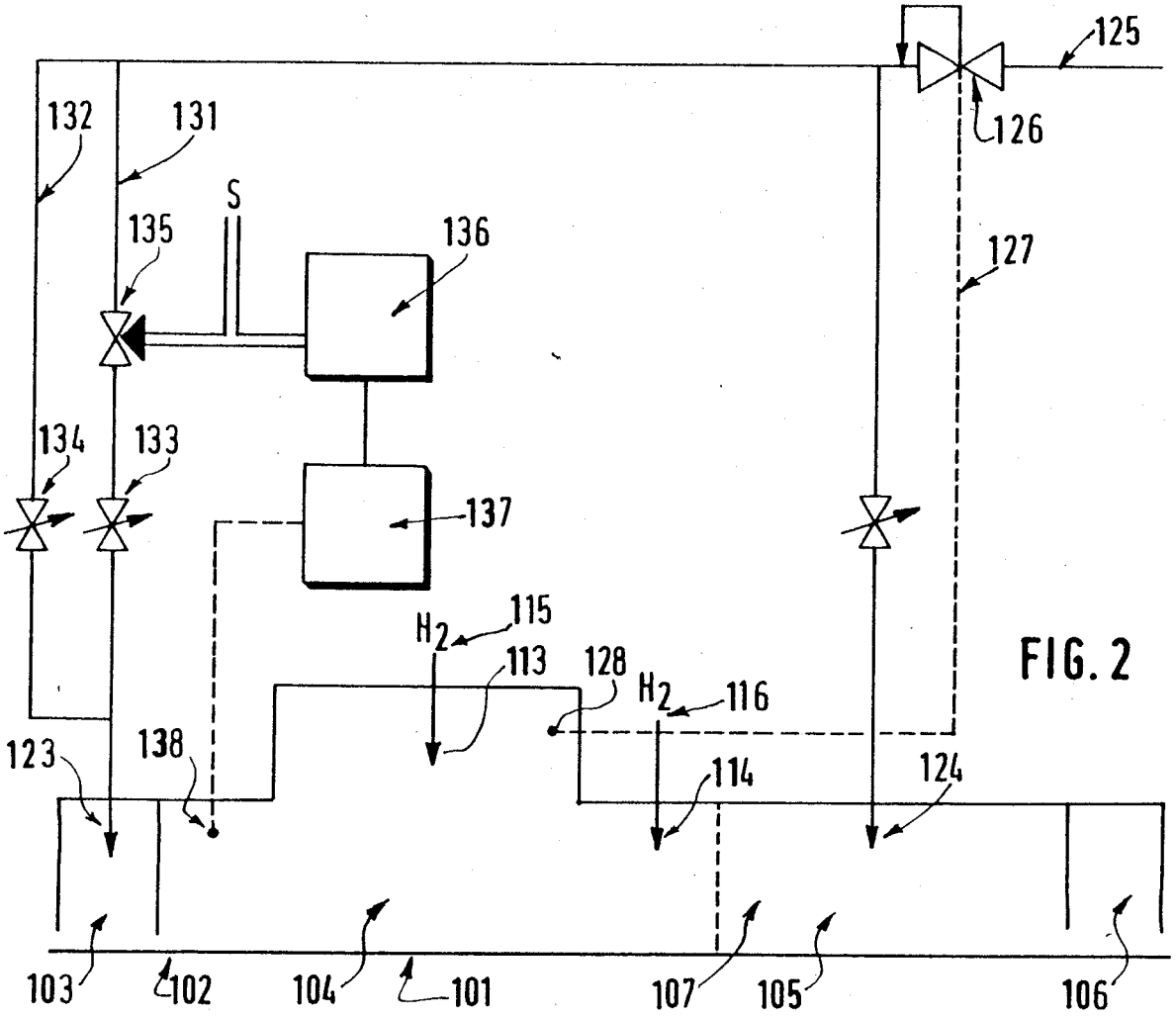
FIG. 2 is a schematic representation of a horizontal furnace in accordance with another illustrative embodiment of the invention.

With reference to FIG. 2, a horizonatal furnace 101 comprises a possibly heated entrance zone 102 including an entrance lock chamber 103 for metal articles (tubes, strips, wires, ....), not shown, followed by a high temperature zone 104, then a cooling zone 105 followed by an exit lock chamber 106.

Placed in the entrance zone 102 and the zone of the downstream part 107 where the temperature becomes lower than 800° C., in the vicinity of the exit zone, are injectors 123 and 124 connected to a nitrogen supply conduit 125 incorporating a flow regulator 126 controlled via a line 127 by a pressure detector 128 in the hot zone 104.

The injector 123 is located in the entrance zone 102 and is supplied by the conduit 125 on the downstream side of the pressure regulator 126 through two parallel conduits 131 and 132. The conduits 131 and 132 respectively incorporate regulator valves 133 and 134. The conduit 131 also incorporates an electrically operated valve 135 controlled through a threshold relay 136 by an analyzer 137 of hydrogen taken off at 138 in a zone located between the hot zone 104 and the injector 123.

The plant of FIG. 2 operates in the following manner. The flow of hydrogen is so regulated as to be fixed at a value which is as low as possible as a function of the needs of the treatment, and the injection of nitrogen in the entrance zone or in the downstream part has essentially the effect of plugs permitting a slight internal high pressure to be achieved while avoiding as far as possible the escape of hydrogen through the entrance lock chamber 103.

The function of the pressure regulator is to react to possible pressure drops while drop below preventing the rise of nitrogen. Indeed, the injection of nitrogen will be amplified simultaneously at the two ends 103 and 107 of the furnace 101 as soon as there occurs a drop in the internal high pressure which is detected by the pressure detector 128.

But if, with the internal pressure however correct, it is found that there is an excessive escape of hydrogen in the entrance zone in the direction of the entrance lock chamber 103, the regulator device 135 will immediately react by a fine increase in the flow of nitrogen conducted through the conduit 131 which thus returns the "escape" flow of hydrogen through the entrance zone to a given value. On the other hand, if the hydrogen content tends to deviate from the prescribed minimum escape flow, and even tends to be cancelled out, the regulator device 135 will ensure a reduction in the nitrogen flow in the conduit 131 and will in this way avoid any rise of nitrogen which might reach the treatment zone 104. Note that it is sufficient to act in this way solely on the entrance zone since the escaping hydrogen has a natural tendency to escape through the cooling zone and a propagation of nitrogen toward the treatment zone 104 through the cooling zone has is highly likely.

In the embodiment shown in FIG. 2, the regulator 135 may also operate in an "all or little" manner, since a minimum flow of nitrogen is ensured through the conduit 132. This arrangement has the advantage of simplicity and ruggedness, since the regulator 135 effects infrequent openings and closures of the electrically operated valve associated therewith, and of safety, since in the event of a breakdown of the regulator device, a minimum flow of nitrogen is always injected in the entrance zone of the furnace through the conduit 132.

The injection in the entrance zone 102 preferably occurs at some distance from the entrance proper so that the oxygen normally adsorbed on the metal strip can be desorbed and be purged by the nitrogen before reaching the nitrogen injection zone, beyond this injection zone the metal strip is located in a zone having a low escape flow of hydrogen. The two conduits 131 and 132 may have different outlets: the conduit 132 may have outlet in the entrance lock chamber 103 and the conduit 131 may have its outlet beyond the latter.

The treatment processes just described permit the use of any dense inert gas, such as nitrogen, argon, carbon dioxide, etc. As, for certain grades of steel, the nitriding may not occur even with nitrogen contents attaining or even exceeding 25%, the process is also valid for relatively low hydrogen contents (higher than 30%) in the annealing zone. The invention is also applicable to the use of active gas in the pure state and/or diluted in a inert gas. For example, the injection at 13 (113) may be pure hydrogen and the injection at 14 (114) may be a mixture of hydrogen and nitrogen, but the hydrogen content is always maximum in the hot zone.

We claim:

1. Process for an annealing treatment of metal articles, in a furnace comprising in interconnected relation: an entrance end zone for the metal articles to be treated, a heating zone, a cooling zone following the heating zone in the direction of travel of the articles through the furnace, and an exit end zone for the treated metal articles, said process comprising injecting a gas having a high hydrogen content in said heating zone and a dense inert gas in the vicinity of said end zones, said process further comprising regulating the injection of the dense inert gas in an end zone under the control of a maintenance of the hydrogen content at a set value in a zone located in the vicinity of said hot zone adjacent to said end zone in which the inert gas injection is under the control of the hydrogen content in a way which increases the injection of dense inert gas if the hydrogen content tends to increase and vice versa, the inert gas flow in said end zone being in any case maintained at a minimum value.

2. Process according to claim 1, comprising regulating the injection of dense inert gas in the vicinity of the two end zones of the furnace under the control of a maintenance of the gas pressure in the furnace at a set value.

3. Process according to claim 1, comprising maintaining the hydrogen content at a set value on the upstream side of said hot zone relative to the travel of said articles through the furnace and effecting the injection of inert gas under the control of the maintenance of the hydrogen content at a set value in the vicinity of the entrance zone of the furnace.

4. Process according to claim 2, comprising regulating the injection of dense inert gas in the vicinity of said two end zones of the furnace by a simultaneous variation in the same sense of the injection flows in the vicinity of said ends of the furnace.

5. Process according to claim 1, wherein the set value of the hydrogen content is between 75% and 99%.

6. Process according to claim 5, applied to a horizontal furnace, wherein the set value of the hydrogen content is between 75% and 99%.

7. Process according to claim 5, applied to a horizontal furnace, wherein the set value of the hydrogen content is on the order of 90%.

8. Process according to claim 5, applied to a vertical furnace, comprising a rising duct and a descending duct, said descending duct incorporating said heating zone and said cooling zone, wherein the set value of the hydrogen content is between 85% and 99.9%.

9. Process according to claim 5, applied to a vertical furnace, comprising a rising duct and a descending duct, said descending duct incorporating said heating zone and said cooling zone, wherein the set value of the hydrogen content is on the order of between 95% and 98%.

10. Process according to claim 8, comprising maintaining the hydrogen content at a set value in the vicinity of an upper end of the rising duct.

11. Process according to claim 1, wherein the dense inert gas is selected from the group consisting of nitrogen, argon, carbon dioxide and a mixture of said gases.

* * * * *